US009217409B2

(12) United States Patent
Kudo et al.

(10) Patent No.: US 9,217,409 B2
(45) Date of Patent: Dec. 22, 2015

(54) STARTER MOTOR CONTROL DURING AUTOMATIC ENGINE STOP

(75) Inventors: Masahito Kudo, Toyota (JP); Shuuji Nakano, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 13/881,460

(22) PCT Filed: Nov. 4, 2010

(86) PCT No.: PCT/JP2010/069564

§ 371 (c)(1),
(2), (4) Date: Apr. 25, 2013

(87) PCT Pub. No.: WO2012/059991

PCT Pub. Date: May 10, 2012

(65) Prior Publication Data

US 2013/0218432 A1 Aug. 22, 2013

(51) Int. Cl.
*F02N 15/02* (2006.01)

(52) U.S. Cl.
CPC ..... *F02N 15/027* (2013.01); *F02N 15/023* (2013.01); *F02N 2200/022* (2013.01); *F02N 2200/041* (2013.01); *F02N 2300/102* (2013.01)

(58) Field of Classification Search
CPC ..... F02N 15/023; F02N 15/027; F02N 2200/022; F02N 2200/041; F02N 2300/102
USPC ..... 701/67; 192/42; 123/179.3
See application file for complete search history.

(56) References Cited

U.S. PATENT DOCUMENTS

| | | | | |
|---|---|---|---|---|
| 7,275,509 | B2 * | 10/2007 | Kassner | 123/179.25 |
| 8,251,034 | B2 * | 8/2012 | Hashim | 123/179.3 |
| 8,408,175 | B2 * | 4/2013 | Schoenek et al. | 123/179.1 |
| 2010/0050970 | A1 | 3/2010 | Okumoto et al. | |
| 2010/0326389 | A1 | 12/2010 | Okumoto et al. | |
| 2011/0184626 | A1 * | 7/2011 | Mauritz et al. | 701/102 |
| 2012/0035837 | A1 | 2/2012 | Okumoto et al. | |

FOREIGN PATENT DOCUMENTS

| | | |
|---|---|---|
| CN | 101666280 A | 3/2010 |
| JP | A-2002-155841 | 5/2002 |
| JP | A-2002-276401 | 9/2002 |

* cited by examiner

*Primary Examiner* — John R Olszewski
*Assistant Examiner* — Todd Melton
(74) *Attorney, Agent, or Firm* — Oliff PLC

(57) ABSTRACT

An internal combustion engine is provided with a ratchet one-way clutch between an output shaft of a starting motor and a crankshaft. The one-way clutch includes a claw piece which rotates integrally with the crankshaft, and an engagement part which rotates integrally with the starting motor and with which the claw piece engages. An electronic control device performs control for driving the starting motor when the engine is stopped to reduce the difference between the rotation speed of the engine and the rotation speed of the starting motor, that is, the difference between the rotation speed of the claw piece and the rotation speed of the engagement part.

14 Claims, 5 Drawing Sheets

STARTER MOTOR CONTROL DURING AUTOMATIC ENGINE STOP

TECHNICAL FIELD

The present invention relates to a controller for a vehicle-mounted internal combustion engine including a one-way clutch between an engine output shaft and an output shaft of an engine cranking motor.

BACKGROUND ART

Patent document 1 describes an example of an internal combustion engine including a ratchet-type one-way clutch arranged between an output shaft of a cranking motor and a crankshaft to transmit torque from the output shaft of the cranking motor to the crankshaft and block the transmission of torque from the crankshaft to the output shaft of the cranking motor. In such a ratchet-type one-way clutch, a pocket is arranged in an inner circumferential surface of an outer ring, which is coupled to the crankshaft. Further, a hook is tiltably supported in a radial direction at a corner of the pocket. An inner ring, which is coupled to the output shaft of the cranking motor, includes an engagement portion that engages the hook. A spring constantly biases the hook toward the radially inner side, that is, in a direction of engagement with the engagement portion.

In such a ratchet-type one-way clutch, when the rotation speed of the outer ring reaches a predetermined rotation speed, which is higher than a cranking rotation speed of the cranking motor and lower than an idle rotation speed of the internal combustion engine, the centrifugal force acting on the hook tilts the hook toward the radially outer side against the biasing force of the spring. This disengages the hook from the engagement portion. Thus, the torque transmission from the ring gear to the crankshaft is blocked. Further, the torque transmission from the crankshaft to the ring gear is blocked by a ratchet mechanism formed by the engagement portion and the hook.

PRIOR ART DOCUMENT

Patent Document

Patent Document 1: Japanese Laid-Open Patent Publication No. 2002-155841

SUMMARY OF THE INVENTION

Problems that the Invention is to Solve

In a conventional internal combustion engine including the ratchet type one-way clutch, the following drawbacks may arise when stopping the engine. Since the hook rotates integrally with the crankshaft, the centrifugal force acting on the hook decreases as the engine rotation speed decreases. When the centrifugal force becomes smaller than the biasing force of the spring acting on the hook, the hook strikes the outer circumferential surface of the inner ring when coming into contact with the still engagement portion and moving over a step of the engagement portion. This produces noise than may be an annoyance to the vehicle occupant.

Such a problem is not limited to engines including the one-way clutch with the structure described in patent document 2. A similar problem occurs in a vehicle-mounted internal combustion that includes a ratchet type one-way clutch arranged between the output shaft of the engine cranking motor and the engine output shaft.

Accordingly, it is an object of the present invention to provide a vehicle-mounted internal combustion engine controller capable of suppressing the production of noise caused when a hook of a one-way clutch moves over a step of an engagement portion, to which the hook is engaged, when stopping the engine.

Means for Solving the Problems

To achieve the above object, a controller according to the present invention is applied to a vehicle-mounted internal combustion engine including a ratchet type one-way clutch between an output shaft of an engine cranking motor and an engine output shaft. The one-way clutch includes a hook, which rotates in cooperation with the engine output shaft, and an engagement portion, which rotates in cooperation with the output shaft of the motor and engages the hook. The controller includes a control unit that performs a control to decrease a deviation degree between a rotation speed of the hook and a rotation speed of the engagement portion when the engine stops.

In this structure, the relative rotation speed of the hook and the engagement portion is decreased compared to a structure in which the control is not performed. Thus, the hook is suppressed from moving over the step of the engagement portion even when the centrifugal force acting on the hook becomes smaller as the engine rotation speed decreases and the hook comes into contact with the engagement portion. In other words, the hook moves over the step of the engagement portion less frequently. Therefore, the generation of noise that occurs when the hook moves over the step of the engagement portion when stopping the engine can be suppressed.

Preferably, the control unit rotates and drives the engagement portion, and controls the rotation speed of the engagement portion to decrease the rotation speed of the engagement portion when the rotation speed of the hook decreases.

Since the rotation speed of the hook basically decreases gradually when stopping the engine, the deviation degree of the rotation speed of the hook and the rotation speed of the engagement portion can be accurately decreased by rotating and driving the engagement portion with the control unit and decreasing the rotation speed of the engagement portion when decreasing the rotation speed of the hook as in the structure described above.

Preferably, the control unit rotates and drives the engagement portion, and controls the rotation speed of the engagement portion to be in synchronization with the rotation speed of the hook.

Since the engine rotation speed gradually decrease while fluctuating when the engine stops, if the rotation speed of the engagement portion is monotonously decreased, the deviation degree of the rotation speed of the hook and the rotation speed of the engagement portion increases and decreases. Thus, there is still room for improvement to accurately reduce the deviation degree over the entire time until when the engine output shaft completely comes to a stop when stopping the engine. In this regard, the deviation degree of the rotation speed of the hook and the rotation speed of the engagement portion can be accurately decreased regardless of the fluctuation of the engine rotation speed by rotating and driving the engagement portion with the control unit and synchronizing the rotation speed of the engagement portion with the rotation speed of the hook as in the structure described above.

Preferably, the control unit rotates and drives the engagement portion, and controls the rotation speed of the engagement portion so that the rotation speed of the engagement portion does not exceed the rotation speed of the hook.

When performing a control to decrease the deviation degree of the rotation speed of the hook and the rotation speed of the engagement portion when the engine stops, the following drawbacks occur when the rotation speed of the engagement portion becomes greater than the rotation speed of the hook. In other words, when the rotation speed of the engagement portion becomes greater than the rotation speed of the hook, the hook engages the engagement portion. The generation of noise by the engagement is the problem. In this case, the engine output shaft is rotated and driven by the torque of the engagement portion. Thus, in the structure for accurately controlling the rotation position of the engine output shaft, that is, the stop phase of the engine output shaft when the rotation is stopped for the next engine cranking control, the stop phase becomes difficult to accurately control and the next engine cranking may not be quickly completed.

In this regard, by rotating and driving the engagement portion with the control unit so that the rotation speed of the engagement portion does not become greater than the rotation speed of the hook, the hook is suppressed from engaging the engagement portion when the rotation speed of the engagement portion becomes greater than the rotation speed of the hook, and the generation of noise caused by such engagement can also be accurately suppressed. The hook is suppressed from being rotated and driven, that is, the engine output shaft suppressed from being rotated and driven by the torque of the engagement portion, and troubles do not hinder the control of the stop phase of the engine output shaft.

Preferably, the control unit rotates and drives the engagement portion, and controls the rotation speed of the engagement portion by performing feedback control based on the deviation degree of the rotation speed of the hook and the rotation speed of the engagement portion.

In this case, the rotation speed of the engagement portion can be accurately set at any given time since the rotation speed of the engagement portion is controlled based on the actual deviation degree of the rotation speed of the hook and the rotation speed of the engagement portion, and the deviation degree can be accurately decreased.

Preferably, the control unit rotates and drives the engagement portion, and controls the rotation speed of the engagement portion by performing feed-forward control.

In this case, the control of the rotation speed of the engagement portion becomes easy and simple since the target changing mode of the rotation speed of the engagement portion is set in advance.

In this case, preferably, the control unit sets in advance a target changing mode of the rotation speed of the engagement portion based on a parameter related to inertial motion of the engine output shaft, and controls the rotation speed of the engagement portion based on the target changing mode.

In this case, preferably, the target changing mode is set based on a state of a load applied by an auxiliary machine, which is driven by the internal combustion engine, to the internal combustion engine.

The engine rotation speed decreases as the load on the engine increases. If the target changing mode of the rotation speed of the engagement portion is set based on the state of the load of the auxiliary machine, which is driven by the internal combustion engine, applied to the internal combustion engine, the target changing mode can be set in accordance with the actual lowering mode of the rotation speed of the hook as in the structure described above. Therefore, the control of decreasing the deviation degree of the rotation speed of the hook and the rotation speed of the engagement portion can be easily and accurately performed when stopping the engine.

Preferably, the rotation speed of the engagement portion is calculated based on the rotation speed of the output shaft of the motor. In this case, an additional structure for recognizing the rotation speed of the engagement portion is unnecessary. Hence, the rotation speed of the engagement portion can be easily and accurately controlled.

Preferably, the rotation speed of the hook is an engine rotation speed. In this case, the structure of the control unit becomes simple since the engine rotation speed is used for the rotation speed of the hook.

Preferably, the control unit rotates and drives the engagement portion when the engine rotation speed is higher than or equal to the cranking determination rotation speed and lower than the predetermined rotation speed, which is lower than the idle rotation speed.

The biasing force of the biasing member for biasing the hook toward the engagement portion is set so that the hook engages with the engagement portion to transmit the torque of the cranking motor to the engine output shaft until the engine rotation speed is higher than or equal to the cranking determination rotation speed and becomes the predetermined rotation speed, which is lower than the idle rotation speed. Therefore, the hook starts to come into contact with the engagement portion when the engine rotation speed becomes lower than or equal to the predetermined rotation speed when stopping the engine.

Preferably, the engagement portion is rotated and driven by power from a battery, and the control unit sets a rotational drive mode of the engagement portion based on a state of charge of the battery.

In this structure, the rotational drive mode of the engagement portion is set based on the state of charge of the battery at any given time, and thus if a mode of stopping the rotational drive of the engagement portion is employed when the state of charge of the battery is lower than a predetermined state, for example, the problem in that the state of charge of the battery overly becomes low due to the rotational drive of the engagement portion may be avoided in a preferable manner. The timing to start the rotational drive of the engagement portion may be delayed or the rotation speed of the engagement portion may be decreased as the state of charge of the battery becomes lower.

Further, to achieve the above object, a controller according to the present invention is applied to a vehicle-mounted internal combustion engine including a ratchet type one-way clutch arranged between an output shaft of an engine cranking motor and an engine output shaft. The one-way clutch includes a hook, which rotates in cooperation with the engine output shaft, and an engagement portion, which rotates in cooperation with the output shaft of the motor and engages the hook. The controller includes a control unit that rotates and drives the engagement portion when an engine rotation speed becomes higher than or equal to a cranking determination rotation speed and lower than a predetermined rotation speed, which is lower than an idle rotation speed.

In the structure described above, the relative rotation speed of the hook and the engagement portion is decreased compared to the structure in which the control is not performed. Thus, the hook is suppressed from moving over the step of the engagement portion even when the centrifugal force acting on the hook becomes smaller as the engine rotation speed decreases, and the hook comes into contact with the engagement portion. In other words, the hook moves over the step of the engagement portion less frequently. Thus, the generation of noise that occurs when the hook moves over the step of the engagement portion when stopping the engine can be suppressed.

In the structure described above, the engagement portion is rotated and driven by the control unit when the engine rotation speed becomes lower than the predetermined rotation speed through the control unit so that the start timing of the rotational drive of the engagement portion can be avoided from becoming unnecessarily fast or excessively slow.

Further, to achieve the above object, a controller according to the present invention is applied to a vehicle-mounted internal combustion engine including a ratchet type one-way clutch arranged between an output shaft of an engine cranking motor and an engine output shaft. The one-way clutch includes a hook, which rotates in cooperation with the engine output shaft, and an engagement portion, which rotates in cooperation with the output shaft of the motor and engages the hook. The controller includes a control unit that drives the motor when the engine stops.

In the structure described above, the relative rotation speed of the hook and the engagement portion is decreased by rotating and driving the engagement portion in cooperation with the output shaft of the motor. Thus, the hook is suppressed from moving over the step of the engagement portion even when the centrifugal force acting on the hook becomes smaller as the engine rotation speed decreases, and the hook comes into contact with the engagement portion. In other words, the hook moves over the step of the engagement portion less frequently. Accordingly, the generation of noise that occurs when the hook moves over the step of the engagement portion as the engine stops may be suppressed.

To achieve the above structure, a controller according to the present invention is applied to a vehicle-mounted internal combustion engine including a ratchet type one-way clutch arranged between an output shaft of an engine cranking motor and an engine output shaft. The one-way clutch includes a hook, which rotates in cooperation with the engine output shaft, and an engagement portion, which rotates in cooperation with the output shaft of the motor and engages the hook. The controller includes a control unit that drives the motor when an engine rotation speed becomes lower than a predetermined rotation speed, which is lower than an idle rotation speed.

In the structure described above, the relative rotation speed of the hook and the engagement portion is decreased by rotating and driving the engagement portion in cooperation with the output shaft of the motor when the engine rotation speed becomes lower than the predetermined rotation speed lower than the idle rotation speed. Thus, the hook is suppressed from moving over the step of the engagement portion even when the centrifugal force acting on the hook becomes smaller as the engine rotation speed decreases, and the hook comes into contact with the engagement portion. In other words, the hook moves over the step of the engagement portion less frequently. Therefore, the generation of noise that occurs when the hook moves over the step of the engagement portion as the engine stops can be suppressed.

Furthermore, according to the structure described above, the rotational drive of the engagement portion is performed when the engine rotation speed becomes lower than the predetermined rotation speed through the control unit so that the starting timing of the rotational drive of the engagement portion can be avoided from becoming unnecessarily fast or excessively slow.

EMBODIMENTS OF THE INVENTION

First Embodiment

Figure 1:
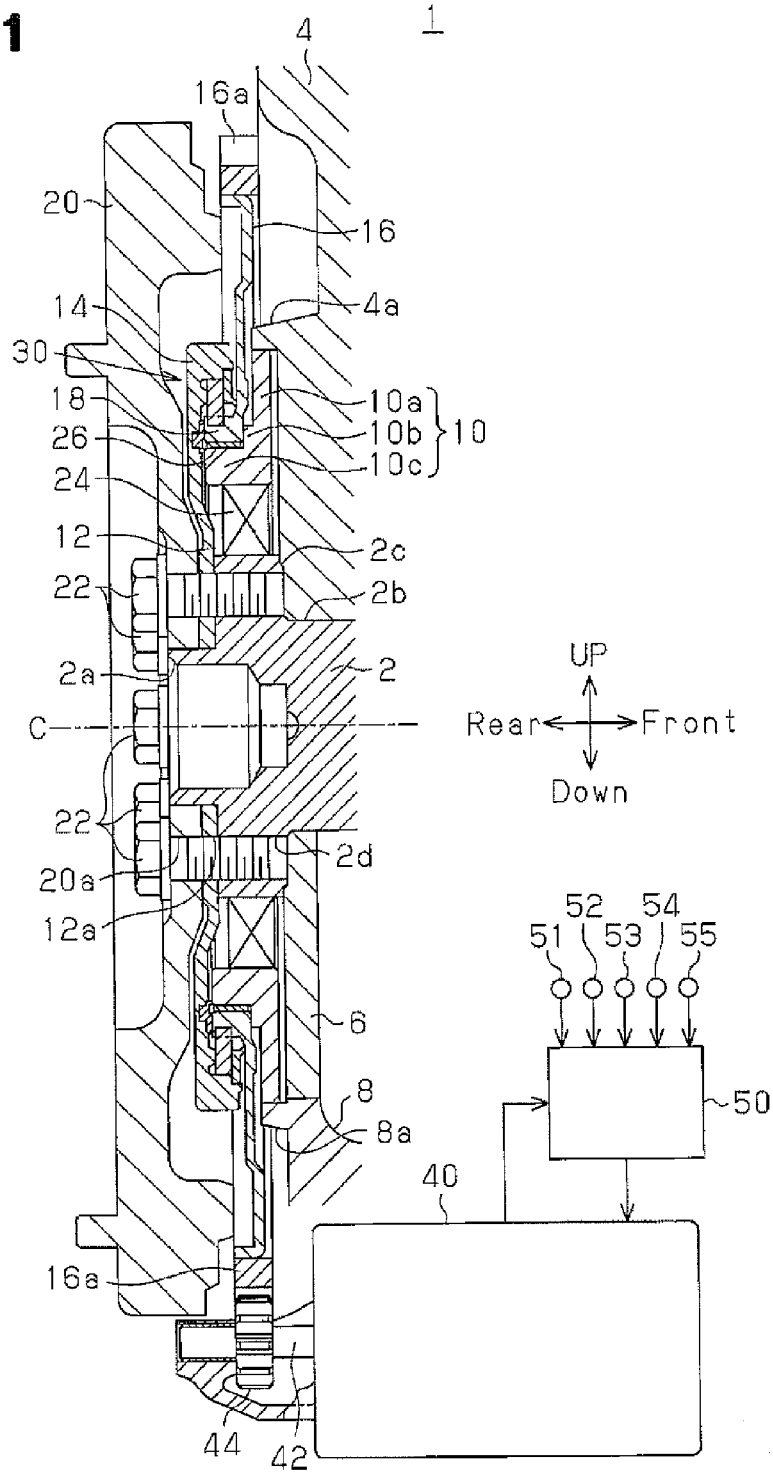
FIG. 1 is a schematic view showing a vehicle-mounted internal combustion engine controller according to a first embodiment of the present invention and an internal combustion engine subject to control by the vehicle-mounted internal combustion engine controller.

A first embodiment of a vehicle-mounted internal combustion engine controller according to the present invention will now be described with reference to FIGS. 1 to 5. The vehicle-mounted internal combustion engine controller is embodied in an electronic controller that centrally controls a vehicle-mounted internal combustion engine FIG. 1 schematically shows the structure of an electronic controller 50 and an internal combustion engine 1, which is subject to control by the electronic controller 50 of the present embodiment. In the present embodiment, an in-line four-cylinder gasoline engine is used as the internal combustion engine 1. Hereinafter, the front side (right side as viewed in FIG. 1) of the internal combustion engine 1 is simply referred to as the "front side", and the rear side (left side in FIG. 1) of the internal combustion engine 1 is simply referred to as the "rear side". The upper side in the vertical direction (upper side in FIG. 1) is simply referred to as the "upper side", and the lower side in the vertical direction (lower side in FIG. 1) is simply referred to as the "lower side".

As shown in FIG. 1, the internal combustion engine 1 includes a rear portion that defines a journal bearing with a cylinder block 4 and a ladder beam 6. The journal bearing supports a journal 2*b* of a crankshaft 2. The crankshaft 2 is thus arranged so that its rear end 2*a* projects toward the rear from the rear portion of the cylinder block 4.

The rear end of the cylinder block 4 includes a fitting portion 4*a* projecting toward the rear. An oil pan 8 that collects oil is attached to the lower side of the ladder beam 6. The rear end of the oil pan 8 includes a fitting portion 8*a* projecting toward the rear. A substantially cylindrical retainer 10 is fitted to the inner circumferences of the fitting portions 4*a* and 8*a*.

The retainer 10 is shaped to have an outer diameter that is decreased in three stages from the front side toward the rear side in the axial direction, and an inner diameter is that remains the same in the axial direction. The portions having these outer diameters define a large diameter portion 10*a*, a medium diameter portion 10*b*, and a small diameter portion 10*c* sequentially from the front side. The large diameter portion 10*a* of the retainer 10 is fitted to the fitting portions 4*a* and 8*a*.

The crankshaft 2 includes a large diameter portion 2*c* projecting in the radial direction toward the front from the rear end 2*a*. An oil seal 24 for suppressing oil leakage from the inside of the internal combustion engine 1 is arranged between an outer circumferential surface of the large diameter portion 2*c* and an inner circumferential surface of the retainer 10.

A cylindrical first bushing 26 is fitted to the outer circumferential surface of the small diameter portion 10*c* of the retainer 10. A ring gear 16, which is substantially disk-shaped and includes a center a hole, is rotatably supported by the outer circumferential surface of the first bushing 26. The ring gear 16 includes a substantially cylindrical inner race 18 having a central inner edge that extends toward the rear in the axial direction. The ring gear 16 includes an outer circumferential end that defines a gear portion 16*a*.

The gear portion 16*a* is constantly engaged with a pinion gear 44, which is arranged on an output shaft 42 of a cranking motor 40. Power is supplied from a vehicle battery (not shown) to the cranking motor 40.

An outer race member 12, which is substantially disk-shaped and includes a center hole, is fixed to the rear side of the large diameter portion 2*c* at the rear end 2*a* of the crankshaft 2. The outer race member 12 includes an inner circumferential surface that comes into contact with the rear end 2*a* of the crankshaft 2 and a front end surface that comes into contact with a rear end surface of the large diameter portion 2*c*. The outer race member 12 includes a substantially cylindrical outer race 14 of which outer edge extends toward the front in the axial direction. The inner circumferential surface of the outer race 14 and the outer circumferential surface of the inner race 18 face each other in the radial direction. The outer race 14 and the inner race 18 form a ratchet type one-way clutch 30 that transmits torque from the cranking motor 40 to the crankshaft 2, and blocks the transmission of torque transmission from the crankshaft 2 to the cranking motor 40.

A flywheel 20, which is substantially disk-shaped and includes a center hole, is fixed to the rear side of the outer race 14 at the rear end 2*a* of the crankshaft 2.

The large diameter portion 2*c* of the crankshaft 2 includes a plurality of bolt holes 2*d* extending along the axial direction and arranged in a circumferential direction. The outer race member 12 and the flywheel 20 respectively include through holes 12*a* and 20*a* extending along the axial direction in correspondence with the bolt holes 2*d*. The crankshaft 2, the outer race member 12, and the flywheel 20 are coupled together by inserting bolts 22 into the bolt holes 2*d* and the through holes 12*a* and 20*a*.

Figure 2:
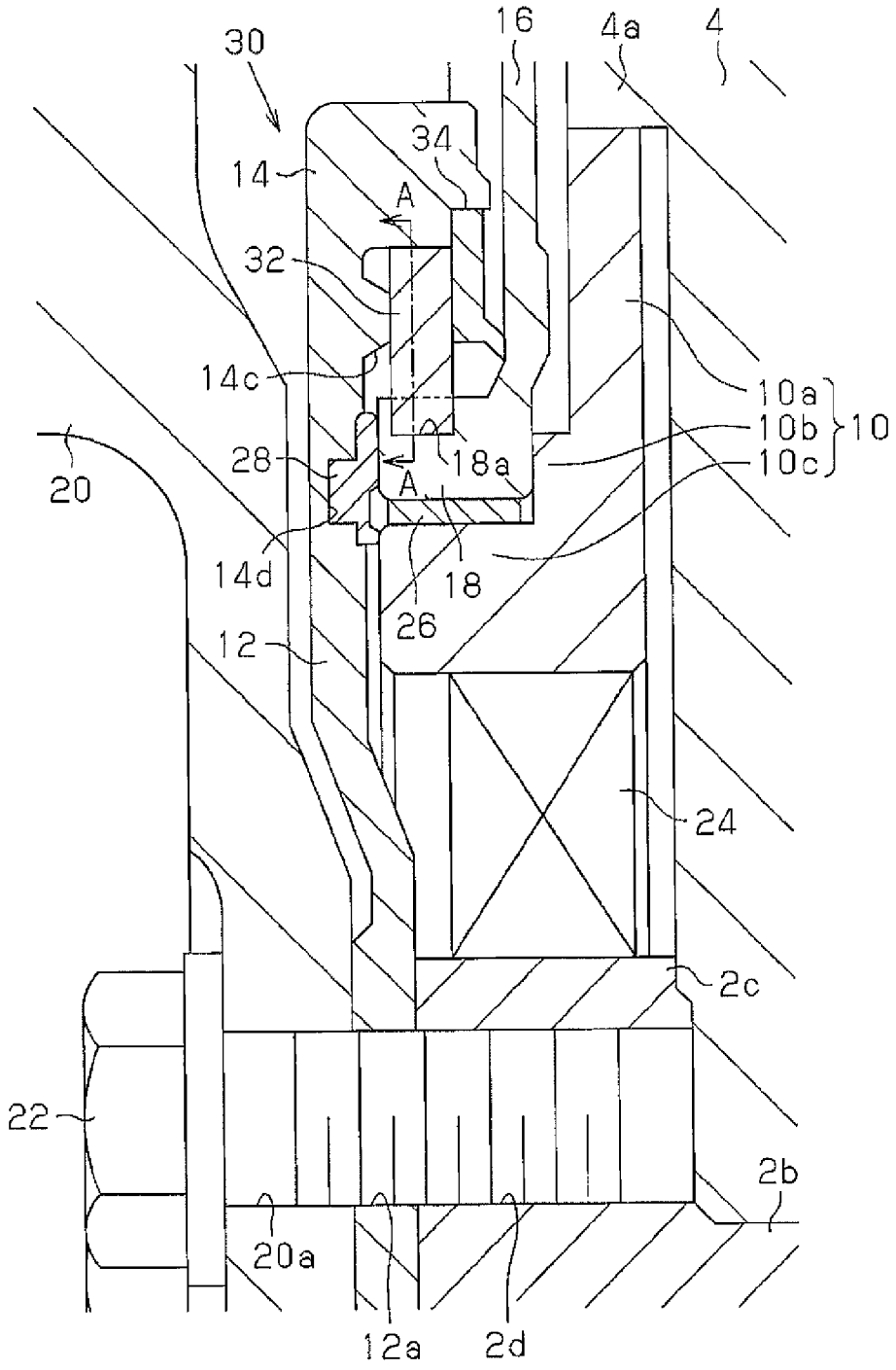
FIG. 2 is an enlarged cross-sectional view mainly showing a one-way clutch in the first embodiment.
Figure 3:
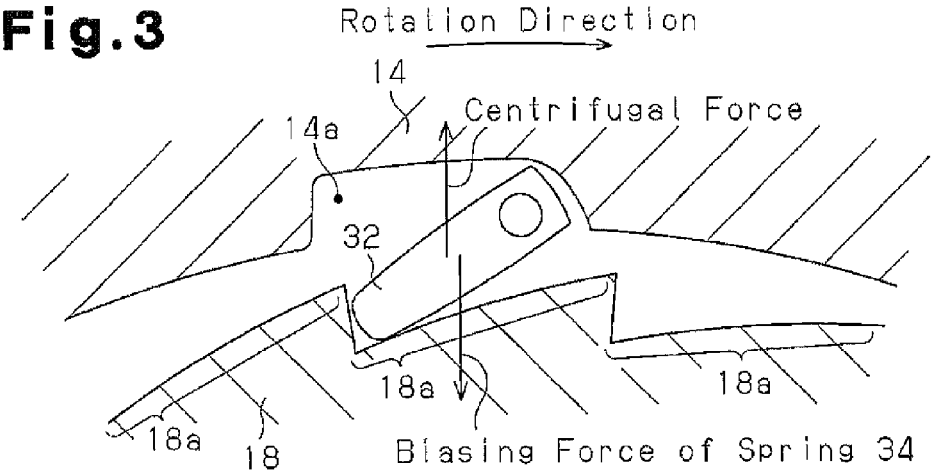
FIG. 3 is a schematic cross-sectional view taken along line A-A in FIG. 2, and is a cross-sectional view showing when a hook is engaged with an engagement portion.

With reference to FIGS. 2 and 3, the structure of mainly the one-way clutch 30 will now be described in detail.

As shown in FIGS. 2 and 3, the one-way clutch 30 includes a hook 32 that rotates in cooperation with the crankshaft 2, and an engagement portion 18*a* that rotates in cooperation with the output shaft 42 of the cranking motor 40 and engages the hook 32.

Specifically, a plurality of hooks 32 are arranged at predetermined angular intervals in the circumferential direction between the outer race 14 and the inner race 18. Torque is transmitted by the hooks 32 from the inner race 18 to the outer race 14 in the same direction, that is, in the clockwise direction as viewed in FIG. 3.

A recess 14*a* for accommodating the hook 32 is formed in correspondence with each hook 32 in the inner circumferential surface of the outer race 14. A spring 34 for tilting and biasing the hook 32 toward the radially inner side of the outer race 14 and the inner race 18 is arranged in each recess 14*a*.

One end of the hook 32 is in contact with a corner in the recess 14*a* located at the front side in the clockwise direction. The hook 32 is tiltable in the radial direction of the outer race 14 and the inner race 18 about the corner.

A plurality of engagement portions 18*a* are continuously formed over the entire outer circumferential surface of the inner race 18 in the circumferential direction.

The engagement portions 18*a* are formed so that the outer diameter gradually increases from a first predetermined value to a second predetermined value toward the front in the clockwise direction, and then returns to the first predetermined value after reaching the second predetermined value. This forms steps to which the hooks 32 can be engaged at the boundaries where the outer diameter changes from the second predetermined value to the first predetermined value.

The members and the portions forming the one-way clutch 30 are broadly divided into a group (hereinafter referred to as group 1) that rotates in cooperation with the output shaft 42 of the cranking motor 40, and a group (hereinafter referred to as group 2) that rotates in cooperation with the crankshaft 2. Group 1 includes the ring gear 16, the inner race 18, and the engagement portion 18*a*. Group 2 includes the hook 32, the outer race 14, and the outer race member 12.

The torque of the output shaft of the cranking motor 40 is sequentially transmitted to the ring gear 16, the inner race 18, and the engagement portion 18*a*. When the hooks 32 are engaged with the engagement portions 18*a*, the torque transmitted to the engagement portion 18*a* as described above is sequentially transmitted to the hook 32, the outer race 14, and the outer race member 12, and ultimately, the crankshaft 2.

A projection 14*c* that projects toward the front and supports each hook 32 is formed at a portion facing the hook 32 in the front end surface of the outer race member 12. A groove 14*d* is formed at a portion facing the inner race 18 in the front end surface of the outer race member 12. A second bushing 28 for supporting the inner race 18 in the axial direction is coupled to the groove 14*d*. Accordingly, the inner race 18 is supported by both of the second bushing 28 and the rear end surface of the medium diameter portion 10*b* of the retainer 10 in the axial direction, and supported by the first bushing 26 in the radial direction.

In the present embodiment, properties such as the mass of the hook 32 and the biasing force of the spring 34 are set so that the biasing force of the spring 34 is greater than the centrifugal force acting on the hook 32 when an engine rotation speed NE is higher than or equal to a cranking determination rotation speed NC (about 400 rpm) and lower than a predetermined rotation speed Nth ($NC \leq NE < Nth$). The predetermined rotation speed Nth is a smaller value than an idle rotation speed NI (about 800 rpm) ($NC \leq Nth < NI$).

In the one-way clutch 30 having such a structure, the hook 32 is biased toward the radially inner side by the biasing force of the spring 34 when the rotation speed of the engagement portion 18*a* is greater than the rotation speed of the crankshaft 2 (hereinafter referred to as engine rotation speed NE) such as when the engine is cranked, so that the hook 32 engages with the engagement portion 18*a*. This couples the inner race 18 and the outer race 14 with the hooks 32, and torque is transmitted from the inner race 18 to the outer race 14.

The hooks 32 rotate integrally with the outer race 14. Thus, when the engine rotation speed NR increases, the centrifugal force acting on the hooks 32 increases accordingly. When the engine rotation speed NE, that is, the rotation speed of the outer race 14 becomes higher than or equal to the predetermined rotation speed Nth, the centrifugal force acting on the hook 32 becomes greater than the biasing force of the spring 34. This outwardly tilts the hooks 32 in the radial direction, and disengages the hooks 32 from the engagement portions 18*a*. Thus, the transmission of torque from the ring gear 16 to the crankshaft 2 is stopped. The torque transmission from the crankshaft 2 to the ring gear 16 is blocked by a ratchet mechanism formed by the engagement portions 18*a* and the hooks 32.

As shown in FIG. 1, the internal combustion engine 1 of the present embodiment is controlled by the electronic controller 50. The electronic controller 50 is connected to an engine rotation speed sensor 51 for detecting the engine rotation speed NE, an ignition switch (hereinafter referred to as IG switch) 52, a brake sensor for detecting a brake operation state of the driver, a selection lever position sensor 54 for detecting an operation position of the selection lever, and an accelerator operation amount sensor 55 for detecting an accelerator operation amount ACCP of the driver. In addition, information such as the intake air amount, the engine coolant temperature, the vehicle speed SPD, the inclination angle of the vehicle, the drive state of an engine-driven auxiliary machine (e.g., hydraulic pump, coolant pump, power generator, air conditioner, etc.), the battery state of charge SOC of a battery, and the like are input to the electronic controller 50.

The electronic controller 50 retrieves the signals output from such various sensors 51 to 55, and executes various types of calculations to control each unit of the engine based on the result.

Specifically, when an ON operation is performed on the IG switch 52, it is assumed that an engine cranking command has been output, and engine cranking control is performed. When an OFF operation is performed on the IG switch 52, it is assumed that an engine stop command has been output, and engine stop control is performed.

Furthermore, the electronic controller 50 of the present embodiment performs an idling stop control. More specifically, when a predetermined automatic stopping condition is satisfied during the engine operation, it is assumed that an engine stop command has been output even if the OFF operation of the IG switch 52 is not performed, and the engine stop control is performed. The predetermined automatic stopping condition may employ a mode in which the predetermined automatic stopping condition is satisfied when following conditions (a) to (c) are all satisfied.

(a) Vehicle speed SPD is lower than or equal to predetermined speed.

(b) Brake pedal is depressed.

(c) Accelerator operation amount ACCP is "0".

When a predetermined re-crank condition is satisfied during the automatic stopping of the engine, it is assumed that an engine cranking command has been output even if the ON operation of the IG switch 52 is not performed, and the engine cranking control is performed. The predetermined re-crank condition may employ a mode in which the predetermined re-crank condition is satisfied when one of the above conditions (b) or (c) is not satisfied.

When the engine stop command is output, the electronic controller 50 stops the fuel injection and ignition to stop the internal combustion engine 1.

When the engine cranking command is output, the cranking motor 40 is driven to perform, cranking.

In the present embodiment, when the engine rotation speed NE becomes higher than or equal to the cranking determination rotation speed NC, the driving of the cranking motor 40 is stopped.

In the present embodiment, to quickly complete the next engine cranking, the rotation position of the crankshaft 2 when the rotation is stopped, that is, the stop phase of the crankshaft 2 is accurately controlled. Specifically, when the engine stops, the magnitude of the auxiliary machine load acting on the crankshaft 2 is controlled so that the stop phase of the crankshaft 2 takes a desired phase.

In the internal combustion engine 1 of the present embodiment, the pinion gear 44, which is coupled to the output shaft 42 of the cranking motor 40, is constantly engaged with the gear portion 16*a* of the ring gear 16. This allows the engine cranking to be quickly completed as compared with a structure that moves and engages the pinion gear with the ring gear when cranking the engine.

In the ratchet type one-way clutch 30, the slide resistance between the inner race 18 and the hooks 32 is subtle after engine cranking. Thus, the mechanical load on the internal combustion engine can be decreased as compared with a sprag type one-way clutch.

Figure 4:
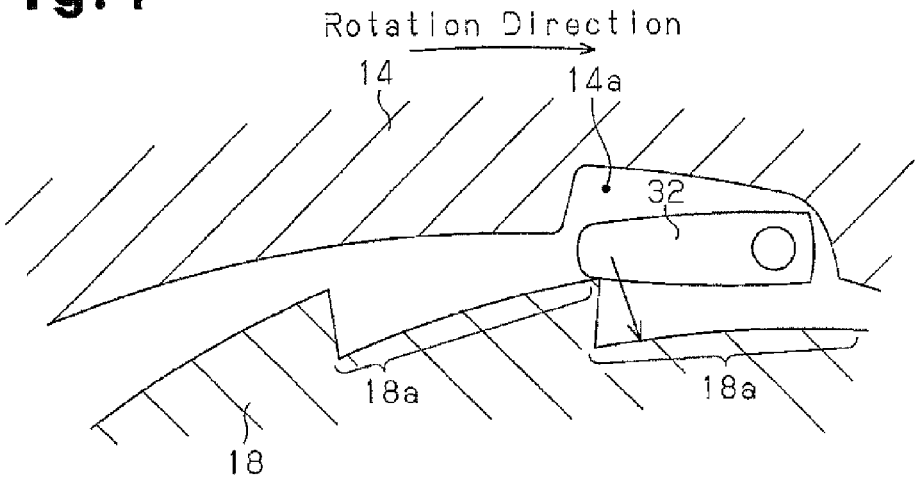
FIG. 4 is a schematic cross-sectional view taken along line A-A in FIG. 2 showing when the hook moves over a step of the engagement portion.

As described above, the present embodiment includes the ratchet type one-way clutch 30. Thus, the following drawbacks may occur when stopping the engine. More specifically, the hooks 32 rotate integrally with the crankshaft 2. Thus, the centrifugal force acting on the hooks 32 decreases as the engine rotation speed NE decreases. Referring to FIG. 4, when the centrifugal force becomes smaller than the biasing force of the springs 34 that acts on the hooks 32, the hooks 32 come into contact with the still engagement portions 18*a*. Further, the hooks 32 strike the outer circumferential surface of the inner race 18 when moving over the steps of the engagement portion 18*a*. This produces noise that may be an annoyance to the passenger.

To resolve such drawbacks, in the present embodiment, when the engine stops, the electronic controller 50 drives the cranking motor 40 to perform a control that decreases the deviation degree of the engine rotation speed NE and the rotation speed of the engagement portion 18*a* (hereinafter referred to as engagement portion rotation speed NK). This suppresses the generation of noise that occurs if the hooks 32 move over the steps of the engagement portion 18*a* when the engine stops. The engagement portion rotation speed NK is the same as the rotation speed of the ring gear 16. Thus in the present embodiment, the engagement portion rotation speed NK is calculated based on the rotation speed of the output shaft 42 of the cranking motor 40 (hereinafter referred to as motor rotation speed NS) and the relationship of the number of teeth of the pinion gear 44 and the number of teeth of the gear portion 16*a* of the ring gear 16.

The procedures for processing the drive control of the cranking motor when the engine stops will now be described with reference to FIG. 5. The electronic controller 50 repeatedly executes the series of processes shown in the flowchart of FIG. 5 in predetermined cycles when the engine is operating.

Figure 5:
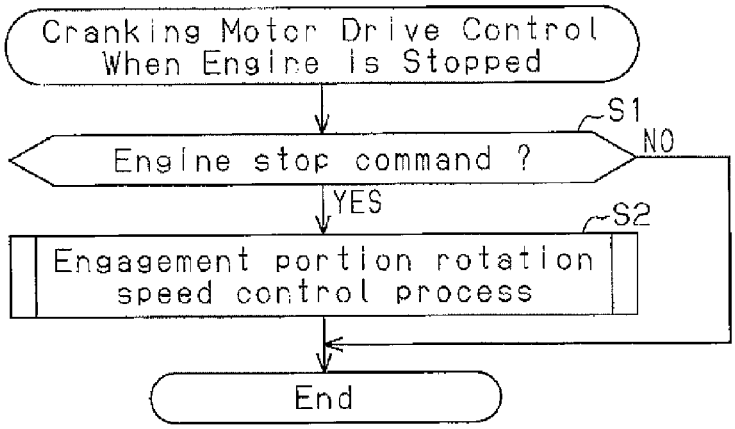
FIG. 5 is a flowchart showing the procedures for processing drive control of the cranking motor in the first embodiment.

Referring to FIG. 5, in the series of processes, first, in step S1, it is determined whether or not an engine stop command has been output. As described above, an engine stop command includes both of a command generated by an OFF operation of the IG switch 52 and a command generated when the predetermined automatic stopping condition is satisfied. As a result, when determined that the engine stop command has not been output, the series of processes is temporarily terminated assuming that it is not the timing to execute the present control.

If determined in step S1 that the engine stop command has been output, the engagement portion rotation speed control processing is executed and the series of processes is temporarily terminated.

The implementation of the engagement portion rotation speed control processing will now be described with reference to FIG. 6.

Figure 6:
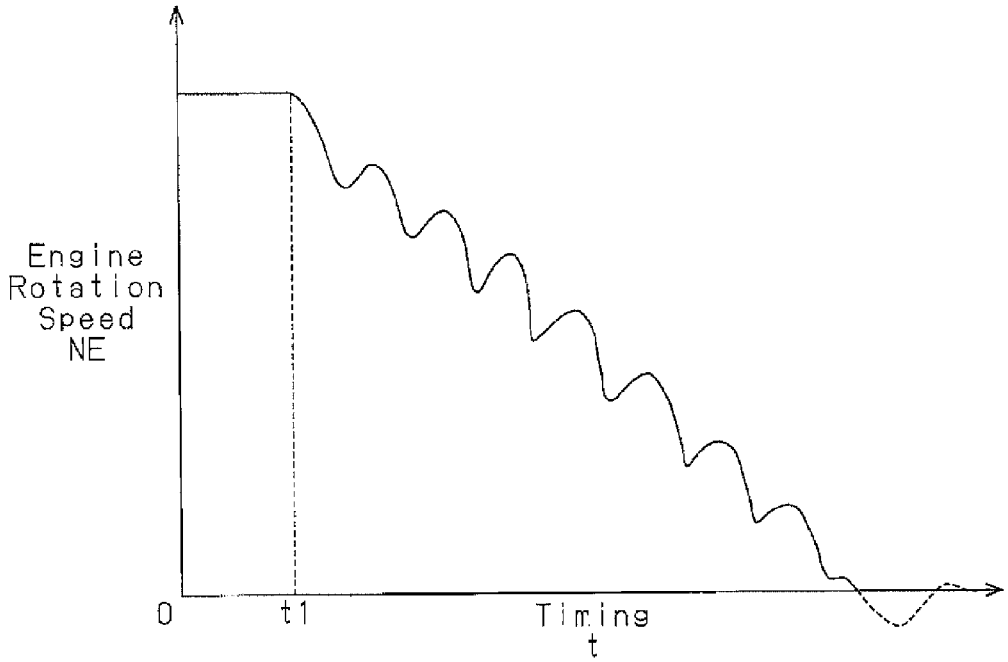
FIG. 6 is a timing chart showing one example of the temporal transition of the engine rotation speed during an engine stop in the first embodiment.

FIG. 6 shows one example of the temporal transition of the engine rotation speed NE when the engine is stopped.

As shown in FIG. 6, when the engine stop command is output and fuel injection and ignition are stopped at timing t1 during the engine operation, the engine rotation speed NE gradually decreases while fluctuating. The electronic controller 50 thus driving the cranking motor 40 immediately after the engine stop command is output to increase the engagement portion rotation speed NK, and controls the engagement portion rotation speed NK so that the engagement portion rotation speed NK decreases when the engine rotation speed NE decreases.

However, when the engagement portion rotation speed NK is monotonously lowered, the deviation degree of the engine rotation speed NE and the engagement portion rotation speed NK increases and decreases as time elapses. Thus, there is still room for improvement when accurately decreasing the deviation degree over the entire time from when the engine stop command is output until the crankshaft 2 completely comes to a stop.

Hence, in the present embodiment, the engagement portion rotation speed NK is controlled by a feedback control (PID control) based on the deviation of the engine rotation speed NE and the engagement portion rotation speed NK. This synchronizes the engagement portion rotation speed NK and the engine rotation speed NE.

The electronic controller 50 functions as a control unit of the present invention. The spring 34 serves as a biasing member of the present invention.

The vehicle-mounted internal combustion engine controller of the present embodiment described above has the advantages described below.

(1) The internal combustion engine 1 includes the ratchet type one-way clutch 30 between the output shaft 42 of the cranking motor 40 and the crankshaft 2. When stopping the engine, the electronic controller 50 drives the cranking motor 40 to perform a control that decreases the deviation degree of the engine rotation speed NE and the engagement portion rotation speed NK. Specifically, the engagement portion rotation speed NK is controlled so that the motor rotation speed NS decreases as the engine rotation speed NE decreases. This decreases the relative rotation speed of the hook 32 and the engagement portion 18*a* as compared to when the control is not performed. Thus, even when the centrifugal force acting on the hooks 32 decreases as the engine rotation speed NE decrease and the hooks 32 come into contact with the engagement portions 18*a*, movement of the hooks 32 over the steps of the engagement portion 18*a* are suppressed. In other words, the hooks 32 moves over the steps of the engagement portion 18*a* less frequently. Accordingly, the generation of noise that occurs when the hooks 32 move over the steps of the engagement portion 18*a* is suppressed when the engine stops.

(2) The electronic controller 50 controls the engagement portion rotation speed NK by performing the feedback control (PID control) based on the deviation of the engine rotation speed NE and the engagement portion rotation speed NK to synchronize the engagement portion rotation speed NK with the engine rotation speed NE. Thus, the deviation degree of the engine rotation speed NE and the engagement rotation speed NK is accurately decreased regardless of the fluctuation of the engine rotation speed NE.

Second Embodiment

A second embodiment of a vehicle-mounted internal combustion engine controller according to the present invention will now be described with reference to FIGS. 7 to 9.

In the first embodiment, when stopping the engine, the cranking motor 40 is driven to control the engagement portion rotation speed NK by performing the feedback control based on the deviation of the engine rotation speed NE and the engagement portion rotation speed NK. The present embodiment differs from the first embodiment in that the engagement portion rotation speed NK (motor rotation speed NS) is controlled by feed-forward control. Otherwise, the structure is the same as the first embodiment, and same components will not be described.

The time required from when the engine stop command is output until the crankshaft 2 comes to a complete stop is short (two to three seconds). Thus, the engagement portion rotation speed NK may not be able to accurately follow the decrease in the engine rotation speed NE depending on the control mode of the feedback control of the control cycle or the like, and the engagement portion rotation speed NK may become greater than the engine rotation speed NE. This may result in the following drawback.

Figure 7:
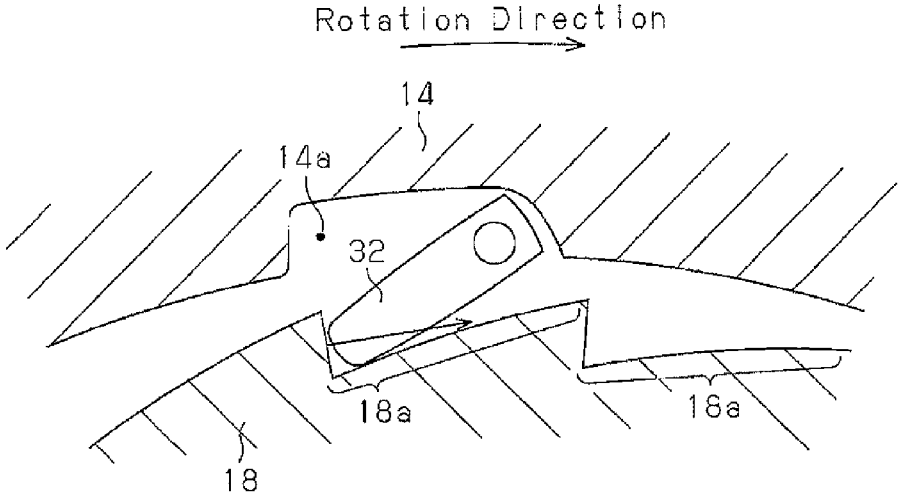
FIG. 7 is a schematic cross-sectional view taken along line A-A in FIG. 2 showing when the engagement portion rotation speed becomes greater than the engine rotation speed as the hook engages the engagement portion.

When the engagement portion rotation speed NK becomes greater than the engine rotation speed NE (NS>NE), the hooks 32 engage with the engagement portions 18*a* in the same manner as when cranking the engine, as shown in FIG. 7. Such engagement results in the generation of noise.

Further, in this case, the crankshaft 2 is rotated and driven by the torque of the cranking motor 40. Thus, in the present embodiment that accurately controls the stop phase of the crankshaft 2 for the next engine cranking control, the stop phase becomes difficult to accurately control, and the next engine cranking may not be quickly completed.

To resolve such a drawback, in the present embodiment, the electronic controller 50 drives the cranking motor 40 to control the engagement portion rotation speed NK so that the engagement portion rotation speed NK does not become greater than the engine rotation speed NE.

Specifically, a target changing mode of the engagement portion rotation speed NK is set in advance based on the auxiliary machine load state when the engine stop command is output. The engagement portion rotation speed NK is controlled based on the set target changing mode. The auxiliary machine load state is the state of the load applied from the auxiliary machines to the internal combustion engine 1.

Figure 8:
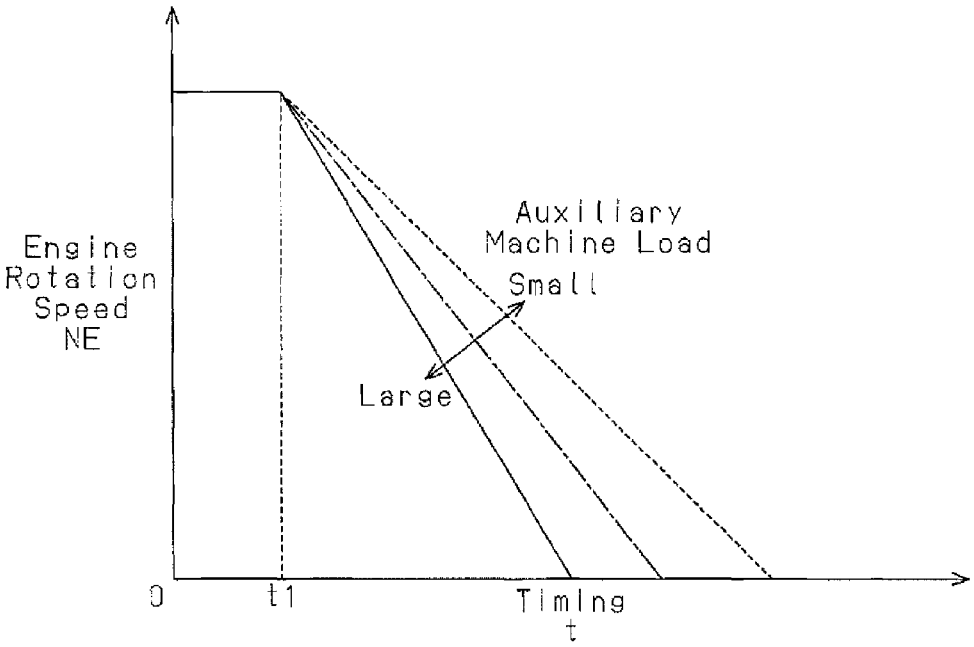
FIG. 8 is a timing chart schematically showing the temporal transition of the engine rotation speed for each of three different auxiliary machine load states according to a second embodiment.

FIG. 8 schematically shows the temporal transition of the engine rotation speed NE for each of three different auxiliary machine load states. In FIG. 8, the auxiliary machine loads are shown with solid lines, single-dashed lines, and broken lines sequentially from the largest auxiliary machine load.

As shown in FIG. 8, the engine resistance of the crankshaft 2 increases as the auxiliary machine load increases. Thus, the engine rotation speed NE quickly decreases.

Therefore, in the present embodiment, the target changing mode is set so that the engagement portion rotation speed NK quickly decreases as the auxiliary machine load increases when the engine stop command is output. The relationship between the auxiliary machine load and the target changing mode is set in advance based on experiments and simulations.

Figure 9:
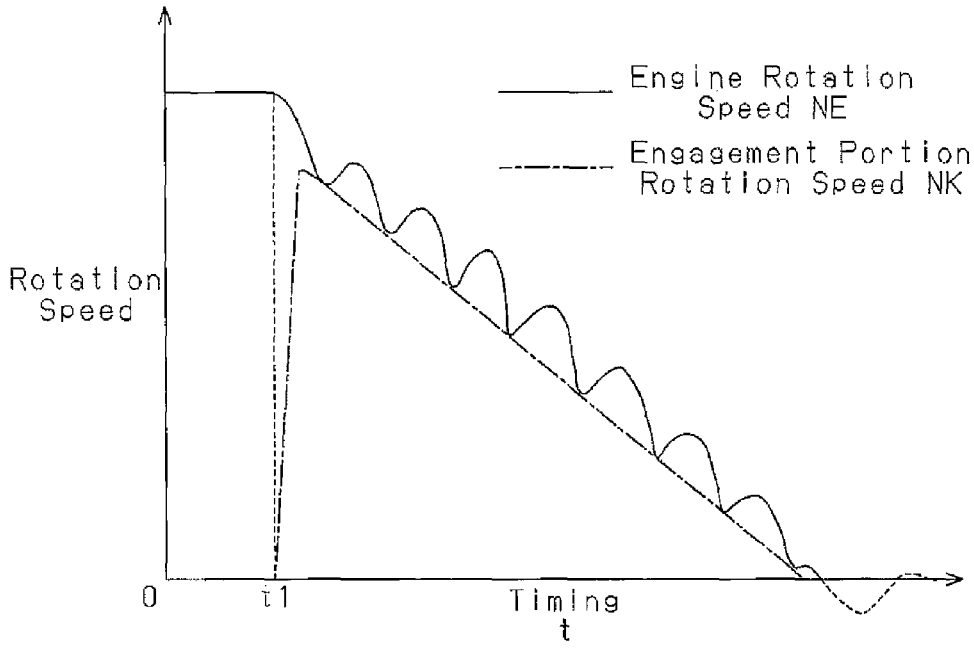
FIG. 9 is a timing chart showing one example of the temporal transition of the engine rotation speed and the motor rotation speed during an engine stop in the second embodiment.

FIG. 9 shows one example of temporal transition of the engine rotation speed NE and the engagement portion rotation speed NK when the engine is stopped.

As shown in FIG. 9, when the engine stop command is output and the fuel injection and the ignition are stopped at timing t1 during the engine operation, the engine rotation speed NE gradually decreases while fluctuating. The electronic controller 50 thus drives the cranking motor 40 immediately after the engine stop command is output, and controls the engagement portion rotation speed NK to increase the engagement portion rotation speed NK and decrease the engagement portion rotation speed NK when the engine rotation speed NE decreases.

In the present embodiment, the engagement portion rotation speed NK is temporarily increased and then monotonously decreased. Specifically, the engagement portion rotation speed NK is controlled to shift along on a straight line connecting values slightly smaller than the minimum values of fluctuation of the engine rotation speed NE.

The vehicle-mounted internal combustion engine controller according to the present embodiment described above has the following advantages in addition to advantage (1) of the first embodiment.

(3) When stopping the engine, the electronic controller 50 drives the cranking motor 40 and controls the engagement portion rotation speed NK so that the engagement portion rotation speed NK does not become greater than the engine rotation speed NE. This suppresses the engagement of the hook 32 with the engagement portion 18*a* when the engagement portion rotation speed NK becomes greater than the engine rotation speed NE, and accurately suppresses the generation of noise that would be generated by such engagement. Further, the hooks 32, that is, the crankshaft 2 is suppressed from being rotated and driven by the torque of the engagement portions 18*a*, and the control of the stop phase of the crankshaft 2 is not hindered.

(4) The electronic controller 50 drives the cranking motor 40 to set in advance the target changing mode of the engagement portion rotation speed NK based on the auxiliary machine load state, and controls the engagement portion rotation speed NK based on the target changing mode. The target changing mode is thus set in accordance with the actual decrease in the engine rotation speed NE. Therefore, the control for reducing the deviation degree of the engine rotation speed NE and the engagement portion rotation speed NK is easily and accurately performed when stopping the engine.

The vehicle-mounted internal combustion engine controller according to the present invention is not limited to the structures exemplified in the embodiments described above, and may be modified in the following forms.

In the structure exemplified in each embodiment described above, the retainer 10 is fitted to the fitting portion 4*a* of the cylinder block 4 and the fitting portion 8*a* of the oil pan 8, and the oil seal 24 is held by the retainer 10. This allows for use of the cylinder block 4, the ladder beam 6, and the oil pan 8 of a convention and typical internal combustion engine that does not include the one-way clutch 30. However, the structure of the cylinder block, the ladder beam, and the oil pan to which the one-way clutch 30 is coupled is not limited to that illustrated in each embodiment described above. For example, a structure in which the oil seal is directly held by the fitting portion of the cylinder head and the fitting portion of the oil pan may be employed. In this case, the retainer may be omitted.

Each embodiment described above employs a structure in which the electronic controller 50, which centrally controls the internal combustion engine 1, performs a drive control on the cranking motor 40. However, a controller (EDU), which performs drive control on the cranking motor 40 when cranking the engine, may be employed in place of the electronic controller 50.

In each embodiment described above, the driving of the cranking motor 40 is started immediately after the engine stop command is output. However, the drive timing of the cranking motor 40 may be delayed when the state of charge SOC of the battery is low, compared to when the state of charge is high, for example. The engagement portion rotation speed NK (motor rotation speed NS) may be decreased when the state of charge SOC of the battery is low compared to when the state of charge is high. In such cases, the power consumed when driving the cranking motor 40 may be saved, and the state of charge of the battery may be suppressed from degrading by the driving of the cranking motor 40. Furthermore, if the state of charge SOC of the battery becomes lower than a predetermined state, the execution of the drive control of the cranking motor may be prohibited. In this case, the problem in which the state of charge of the battery becomes excessive due to the rotational driving of the engagement portion 18*a* may be avoided in an ensured manner.

In each embodiment described above, the driving of the cranking motor 40 is started immediately after the engine stop command is output, but the drive starting timing of the cranking motor 40 is not limited in such a manner. As described above, when the engine rotation speed NE becomes lower than or equal to the predetermined rotation speed Nth when the engine is stopped, the hooks 32 start to come into contact with the engagement portions 18*a*. Thus, if the drive of the cranking motor 40 is performed when the engine rotation speed NE becomes lower than the predetermined rotation speed Nth instead of starting the driving of the cranking motor 40 immediately after the engine stop command is output, the starting timing for driving the cranking motor 40 may be prevented from becoming unnecessarily fast or excessively slow.

In the embodiments described above, the same structure in which the outer race 14 is coupled to the crankshaft 2 and the engine rotation speed NE and the rotation speed of the hook 32 is employed. Thus, the rotation speed of the hook 32 can be directly recognized from the engine rotation speed NE. However, for example, when employing a structure in which the crankshaft 2 and the outer race 14 are indirectly coupled and the engine rotation speed NE and the rotation speed of the outer race 14 are different, a means for detecting or estimating the rotation speed of the hook 32 may be used, and the drive control of the cranking motor may be performed using the rotation speed of the hook 32 instead of the engine rotation speed NE.

In the embodiments described above, the structure in which the motor rotation speed NS and the engagement portion rotation speed NK are different is employed. Thus, the engagement portion rotation speed NK can be recognized based on the motor rotation speed NS. However, for example, when employing a structure in which the motor rotation speed NS and the engagement portion rotation speed NK are the same, the engagement portion rotation speed NK may be directly recognized from the motor rotation speed NS, and the drive control of the cranking motor may be performed using the motor rotation speed NS.

In the second embodiment described above, the target changing mode of the engagement portion rotation speed NK is set in advance based on the auxiliary machine load state of the internal combustion engine 1. However, the parameter for setting the target changing mode of the engagement portion rotation speed NK is not limited in such a manner. For example, an engine coolant temperature or a lubricating oil temperature may be used as parameters that influence the engine resistance. Parameters related to other engine operation states and parameters related to the vehicle state may be employed as parameters that influence the inertial motion of the crankshaft 2.

In the second embodiment described above, the engagement portion rotation speed NK is gradually decreased when stopping the engine. However, the present invention is not limited in such a manner. For example, the cranking motor 40 may be driven during a predetermined period from when the engine stop command is output until when the crankshaft 2 is rotation stopped to maintain the engagement portion rotation speed NK at a predetermined value. In summary, the deviation degree of the engine rotation speed NE and the engagement portion rotation speed NK only need to be small by driving the cranking motor 40 as compared to when the motor is not driven at all.

In each embodiment described above, the cranking motor 40 is driven to perform a control for decreasing the deviation degree of the rotation speed of the hooks 32 and the rotation speed of the engagement portions 18*a*, which engage the hooks 32 forming the one-way clutch 30, when stopping the engine. A means for decreasing the deviation degree is not limited to driving the cranking motor 40, and the engagement portion 18*a* may be rotated and driven by a drive device differing from the cranking motor 40, for example. In summary, when stopping the engine, the control only needs to decrease the deviation degree of the rotation speed of the hooks and the rotation speed of the engagement portions.

The present invention is not limited to performing the control for decreasing the deviation degree of the rotation speed of the hook and the rotation speed of the engagement portion when stopping the engine. For example, the problems solved by the invention of the present application may also be also be solved by the technical concept of rotatably driving the engagement portion when the engine rotation speed becomes higher than or equal to the cranking determination rotation speed and lower than a predetermined rotation speed, which is lower than the idle rotation speed. In this case, the technical concept may be embodied in a structure according to any one of claims 2 to 12, which are dependent on claim 1. In this case as well, the present invention is not limited to the structure of gradually decreasing the rotation speed of the engagement portion when stopping the engine, and may rotatably drive the engagement portion when the engine rotation speed becomes lower than the predetermined rotation speed to maintain the rotation speed of the engagement portion at a predetermined value.

The problems solved by the invention of the present application may also be solved by the technical concept of driving the motor when stopping the engine. In this case, the technical concept may be embodied in a structure according to any one of claims 2 to 12, which are dependent on claim 1. In this case as well, the present invention is not limited to the structure of gradually decreasing the rotation speed of the engagement portion when stopping the engine, and may drive the motor to maintain the rotation speed of the engagement portion at a predetermined value when stopping the engine.

The problems solved by the invention of the present application may also be solved by the technical concept of driving the motor when the engine rotation speed becomes lower than a predetermined rotation speed that is lower than the idle rotation speed. In this case, the technical concept may be embodied with in a structure according to any one of claims 2 to 12, which are dependent on claim 1. In this case as well, the present invention is not limited to the structure of gradually decreasing the rotation speed of the engagement portion when the engine rotation speed becomes lower than the predetermined rotation speed, and may drive the motor when the engine rotation speed becomes lower than the predetermined rotation speed to maintain the rotation speed of the engagement portion at a predetermined value.

DESCRIPTION OF REFERENCE CHARACTERS

1 internal combustion engine
2 crankshaft
2*a* rear end
2*b* journal
2*c* large diameter portion
2*d* bolt hole
4 cylinder block
4*a* fitting portion
6 ladder beam
8 oil pan
8*a* fitting portion
10 retainer
10*a* large diameter portion
10*b* medium diameter portion
10*c* small diameter portion
12 outer race member
12*a* through hole
14 outer race
14*a* recess
14*c* projection
14*d* groove
16 ring gear
16*a* gear portion
18 inner race
18*a* engagement portion
20 flywheel
20*a* through hole
22 bolt
24 oil seal
26 first bushing
28 second bushing
30 one-way clutch
32 hook
34 spring
40 cranking motor
42 output shaft
44 pinion gear
50 electronic controller
51 engine rotation speed sensor
52 IG switch
53 brake sensor
54 selection lever position sensor
55 accelerator operation amount sensor
C center axis of rotation

The invention claimed is:

1. A controller for a vehicle-mounted internal combustion engine including a ratchet type one-way clutch disposed between an output shaft of an engine cranking motor and an engine output shaft, the one-way clutch including: (i) a hook configured to rotate in cooperation with the engine output shaft about a rotation axis of the engine output shaft, and (ii) an engagement portion configured to rotate in cooperation with the output shaft of the motor about the rotation axis of the engine output shaft and to engage the hook, the hook being configured to move away from the engagement portion as a centrifugal force acting on the hook increases, the controller comprising:

a control unit configured to:

determine whether an engine stop command has been output, and decrease a deviation degree between a rotation speed of the hook and a rotation speed of the engagement portion when determining that the engine stop command has been output.

2. The controller according to claim 1, wherein the control unit rotates and drives the engagement portion and controls the rotation speed of the engagement portion to decrease the rotation speed of the engagement portion when the rotation speed of the hook decreases.

3. The controller according to claim 1, wherein the control unit rotates and drives the engagement portion, and controls the rotation speed of the engagement portion to be in synchronization with the rotation speed of the hook.

4. The controller according to claim 1, wherein the control unit rotates and drives the engagement portion, and controls the rotation speed of the engagement portion so that the rotation speed of the engagement portion does not exceed the rotation speed of the hook.

5. The controller according to claim 1, wherein the control unit rotates and drives the engagement portion, and controls the rotation speed of the engagement portion by performing feedback control based on the deviation degree of the rotation speed of the hook and the rotation speed of the engagement portion.

6. The controller according to claim 1, wherein the control unit rotates and drives the engagement portion, and controls the rotation speed of the engagement portion by performing feed-forward control.

7. The controller according to claim 6, wherein the control unit sets in advance a target changing mode of the rotation speed of the engagement portion based on a parameter related to inertial motion of the engine output shaft, and controls the rotation speed of the engagement portion based on the target changing mode.

8. The controller according to claim 7, wherein the target changing mode is set based on a state of a load applied by an auxiliary machine, which is driven by the internal combustion engine, to the internal combustion engine.

9. The controller according to claim 1, wherein the rotation speed of the engagement portion is calculated based on the rotation speed of the output shaft of the motor.

10. The controller according to claim 1, wherein the rotation speed of the hook is an engine rotation speed.

11. The controller according to claim 1, wherein the engagement portion is rotated and driven by power from a battery; and the control unit sets a rotational drive mode of the engagement portion based on a state of charge of the battery.

12. A controller for a vehicle-mounted internal combustion engine including a ratchet type one-way clutch disposed between an output shaft of an engine cranking motor and an engine output shaft, the one-way clutch including: (i) a hook configured to rotate in cooperation with the engine output shaft, and (ii) an engagement portion configured to rotate in cooperation with the output shaft of the motor and to engage the hook, the hook being configured to move away from the engagement portion as a centrifugal force acting on the hook increases, the controller comprising:

a control unit configured to:

determine whether an engine rotation speed becomes lower than a predetermined rotation speed, which is lower than an idle rotation speed, and higher than or equal to a cranking determination rotation speed, and rotate the engagement portion when determining that the engine rotation speed becomes higher than or equal to the cranking determination rotation speed and lower than the predetermined rotation speed.

13. A controller for a vehicle-mounted internal combustion engine including a ratchet type one-way clutch disposed between an output shaft of an engine cranking motor and an engine output shaft, the one-way clutch including: (i) a hook configured to rotate in cooperation with the engine output shaft, and (ii) an engagement portion configured to rotate in cooperation with the output shaft of the motor and to engage the hook, the hook being configured to move away from the engagement portion as a centrifugal force acting on the hook increases, the controller comprising:

a control unit configured to drive the engine cranking motor when an engine rotation speed decreases as the engine stops, regardless of a presence or absence of an engine cranking command.

14. A controller for a vehicle-mounted internal combustion engine including a ratchet type one-way clutch disposed between an output shaft of an engine cranking motor and an engine output shaft, the one-way clutch including: (i) a hook configured to rotate in cooperation with the engine output shaft, and (ii) an engagement portion configured to rotate in cooperation with the output shaft of the motor and to engage the hook, the hook being configured to move away from the engagement portion as a centrifugal force acting on the hook increases, the controller comprising:

a control unit configured to drive the engine cranking motor when an engine rotation speed decreases and becomes lower than a predetermined rotation speed, which is lower than an idle rotation speed, regardless of a presence or absence of an engine cranking command.

* * * * *